US007520711B2

(12) United States Patent
Lee

(10) Patent No.: US 7,520,711 B2
(45) Date of Patent: Apr. 21, 2009

(54) SYSTEM FOR COLLECTING LIQUIDS FROM SCRAPPED VEHICLES

(75) Inventor: Won Bae Lee, Seoul (KR)

(73) Assignee: Hyundai Motor Company (KR)

( * ) Notice: Subject to any disclaimer, the term of this patent is extended or adjusted under 35 U.S.C. 154(b) by 557 days.

(21) Appl. No.: 11/220,249

(22) Filed: Sep. 6, 2005

(65) Prior Publication Data

US 2006/0049002 A1 Mar. 9, 2006

(30) Foreign Application Priority Data

Sep. 6, 2004 (KR) ..... 10-2004-0070695

(51) Int. Cl.
*B66B 17/20* (2006.01)

(52) U.S. Cl. ..... 414/611; 182/131

(58) Field of Classification Search ..... 182/1, 182/142, 131

See application file for complete search history.

(56) References Cited

U.S. PATENT DOCUMENTS 1,725,302 A * 8/1929 Riddle et al. ..... 269/58
2,695,076 A * 11/1954 Yordi ..... 187/203
4,694,674 A * 9/1987 Lawrence ..... 72/305
5,371,993 A * 12/1994 Saito ..... 52/745.1
5,727,656 A 3/1998 Gaudioso et al.
6,223,855 B1 * 5/2001 Lindner ..... 182/131
6,845,848 B1 1/2005 Kritzer

FOREIGN PATENT DOCUMENTS

KR 10-20010035583 A 5/2001

* cited by examiner

*Primary Examiner*—Saúl J Rodríguez
*Assistant Examiner*—Joshua I Rudawitz
(74) *Attorney, Agent, or Firm*—Morgan, Lewis & Bockius LLP

(57) ABSTRACT

A system for collecting liquids from scrapped vehicles, suitable for completely collecting liquids remaining in a scrapped vehicle, such as fuel, engine oil, brake oil, transmission oil and the like. The system includes a floor having rails positioned in a longitudinal direction on which a bogie frame moves, a lift having posts and carriages for raising the bogie frame together with a scrapped vehicle loaded thereon, a first scaffold and a second scaffold, hydraulic cylinders installed at each corner of the second scaffold, thereby adjusting the height of the second scaffold and a control panel for controlling the operation of collection of liquids from a scrapped vehicle.

2 Claims, 6 Drawing Sheets

SYSTEM FOR COLLECTING LIQUIDS FROM SCRAPPED VEHICLES

CROSS REFERENCE TO RELATED APPLICATION

This application is based on, and claims priorities to Korean Patent Applications No. 10-2004-0070695, filed on Sep. 6, 2004, the disclosure of which is hereby incorporated by reference.

TECHNICAL FIELD OF THE INVENTION

The present invention relates to a system for collecting liquids from a scrapped vehicle. More particularly, the system is suitable for easily collecting entire liquids remaining in a scrapped vehicle, such as fuel, engine oil, brake oil, transmission oil and the like.

BACKGROUND OF THE INVENTION

As the number of new vehicles being purchased increases year by year, the number of secondhand vehicles and scrapped vehicles has been also increased in proportion thereto. Because the majority of the scrapped vehicles still contain liquids therein such as engine oil, transmission oil, fuel, washer, and the like, it is necessary to collect the liquids before a scrapping process.

In view of environmental protection and prevention of contamination, liquids remaining in a scrapped vehicle should be drained and collected to a safe place before the scrapping process is initiated. In order to prevent soil contamination, most countries have regulations concerning the collection of liquids in a scrapping process of vehicles.

Generally, liquid collecting work is initiated when the scrapped vehicle is loaded onto the supporting frame of a lift apparatus. However, such system are disadvantageous in that it is troublesome to collect the liquids from the scrapped vehicle because access to an engine compartment is quite restricted due to its inherent structure. Further, because the scrapped vehicle is usually maintained in parallel with ground level while collecting the liquids therefrom, smalls amount of liquids often remains in the vehicle.

SUMMARY OF THE INVENTION

Embodiments of the present invention provide a system for collecting liquids from a scrapped vehicle, which provides full accessibility to an engine compartment of the vehicle for easily collecting liquids therefrom.

Embodiments of the present invention further provide systems for collecting liquids from a scrapped vehicle by which the vehicle loaded thereon is capable of being tilted so as to collect most or all the entire liquids remaining in the vehicle.

Embodiments of the present invention also provide systems for collecting liquids from a scrapped vehicle in which liquids falling to a floor during collecting process are collected by means of an additional collecting means so that the working site can be maintained clear.

Embodiments of the present invention also provide systems for collecting liquids from a scrapped vehicle, which comprises an automated transporting means for the scrapped vehicle, thereby reducing time-consuming operations and labor-intensive processes involved in transporting the vehicle.

An exemplary embodiment of a system for collecting liquids from a scrapped vehicle includes a floor having rails positioned in longitudinal direction thereon on which a bogie frame moves back and forth via the rails, and a lift having plural posts and carriages, which raises the bogie frame together with a scrapped vehicle loaded thereon. An exemplary embodiment may be provided with first and second scaffolds that are installed in the longitudinal direction of the floor and in the traverse direction of the floor, respectively. One end of the first scaffold perpendicularly meets one end of the second scaffold such that an operator can freely pass over the scaffolds. The second scaffold is furnished with a plurality of hydraulic cylinders for adjusting the height thereof. An embodiment of the present invention may further comprise a control panel and a set of sucking pumps, which are preferably disposed below the first scaffold.

In one further exemplary embodiment, the second scaffold includes an auxiliary plate to improve the accessibility to the engine compartment of a scrapped vehicle. As occasion demands, the auxiliary plate is movable toward the engine compartment of the scrapped vehicle by means of a hydraulic actuating means.

In another exemplary embodiment, the carriages are equipped with engagers of different heights.

In yet another exemplary embodiment, the floor is composed of an upper plate of the substantially reversed U-shape and a lower plate of the substantially U-shape. The upper plate is inserted into the lower plate such that a cavity for catchment is formed between the upper plate and the lower plate.

BRIEF DESCRIPTION OF THE DRAWINGS

The aforementioned aspects and other features of the present invention will be explained in the following detailed description, taken in conjunction with the accompanying drawings, wherein.

DETAILED DESCRIPTION OF PREFERRED EMBODIMENTS

Figure 1:
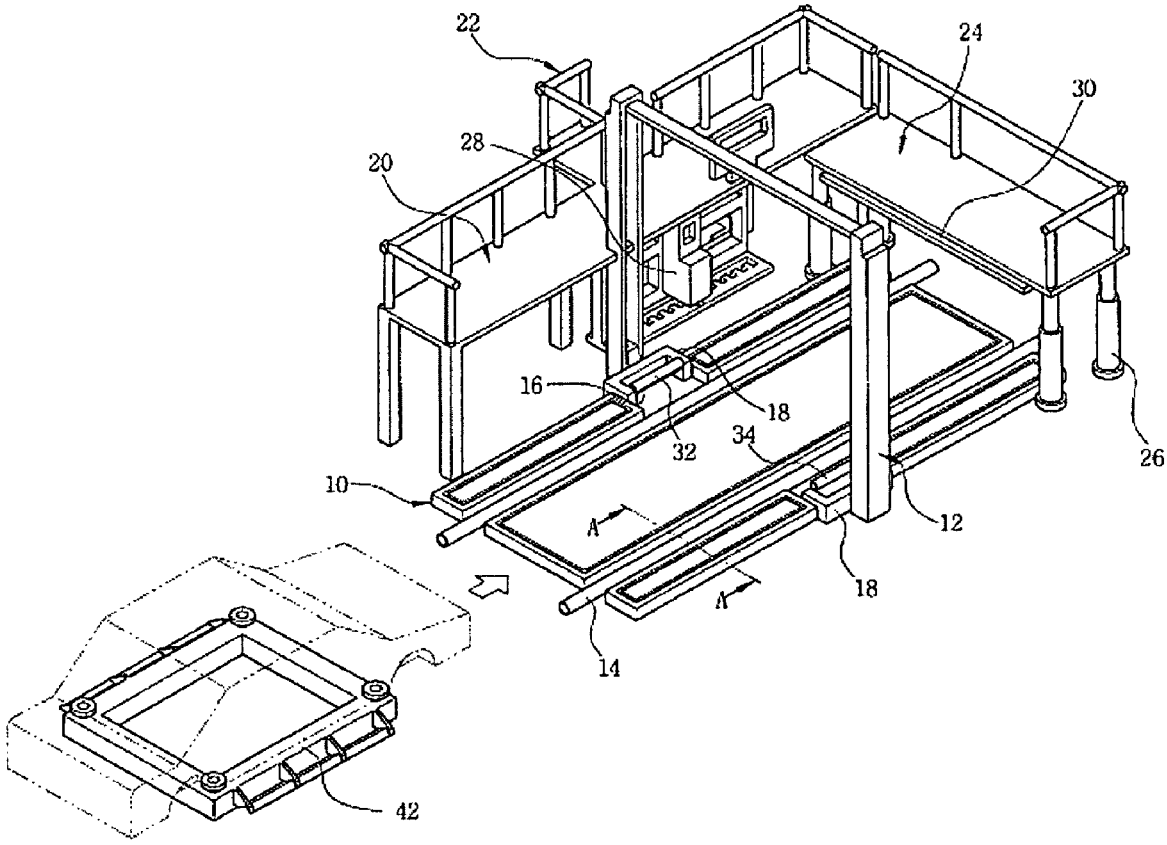
FIG. 1 is a perspective view of a system for collecting liquids from scrapped vehicles according to one embodiment of the present invention, in which a scrapped vehicle is about to enter the system by means of a bogie frame.

In FIGS. 1 to 4, showing an exemplary embodiment of the present invention, floor 10 is composed of rectangular plates, between which rails 14 are disposed in the longitudinal direction thereof. A lift 12 having two posts is positioned midway from each end of the floor 10. The floor 12 is provided with discontinued areas 16 to receive a carriage 18 of the lift 12 therein at both side of the floor 10.

Constructed along the longitudinal direction of the floor 10 is a first scaffold 20, on which a worker operates on a scrapped vehicle. The first scaffold 20 is furnished with a stair structure 22 to for the worker to step up the first scaffold 20.

A second scaffold 24 is constructed in such a manner that one end of the first scaffold 20 perpendicularly meets one end of the second scaffold 24 such that the second scaffold 24 is closed to an engine compartment of the scrapped vehicle while providing ease access to the engine compartment. Installed at each corner of the second scaffold 24 is a hydraulic cylinder 26 by which the height of the second scaffold 24 can be adjusted at need.

A control panel 28 for automatically controlling the operation of collection of liquids from a scrapped vehicle is equipped below the first scaffold 20. Even though not shown in the accompanying drawings, it is preferable to provide a plurality of suction pumps for collecting various kinds of liquids and other equipments (for example, a collecting container) for collecting the liquids below the first scaffold 20.

The second scaffold 24 is further provided with an auxiliary plate 30 to improve the accessibility to the engine compartment of a scrapped vehicle, which can be slideably extended toward the engine compartment by means of a hydraulic actuating means.

Figure 5:
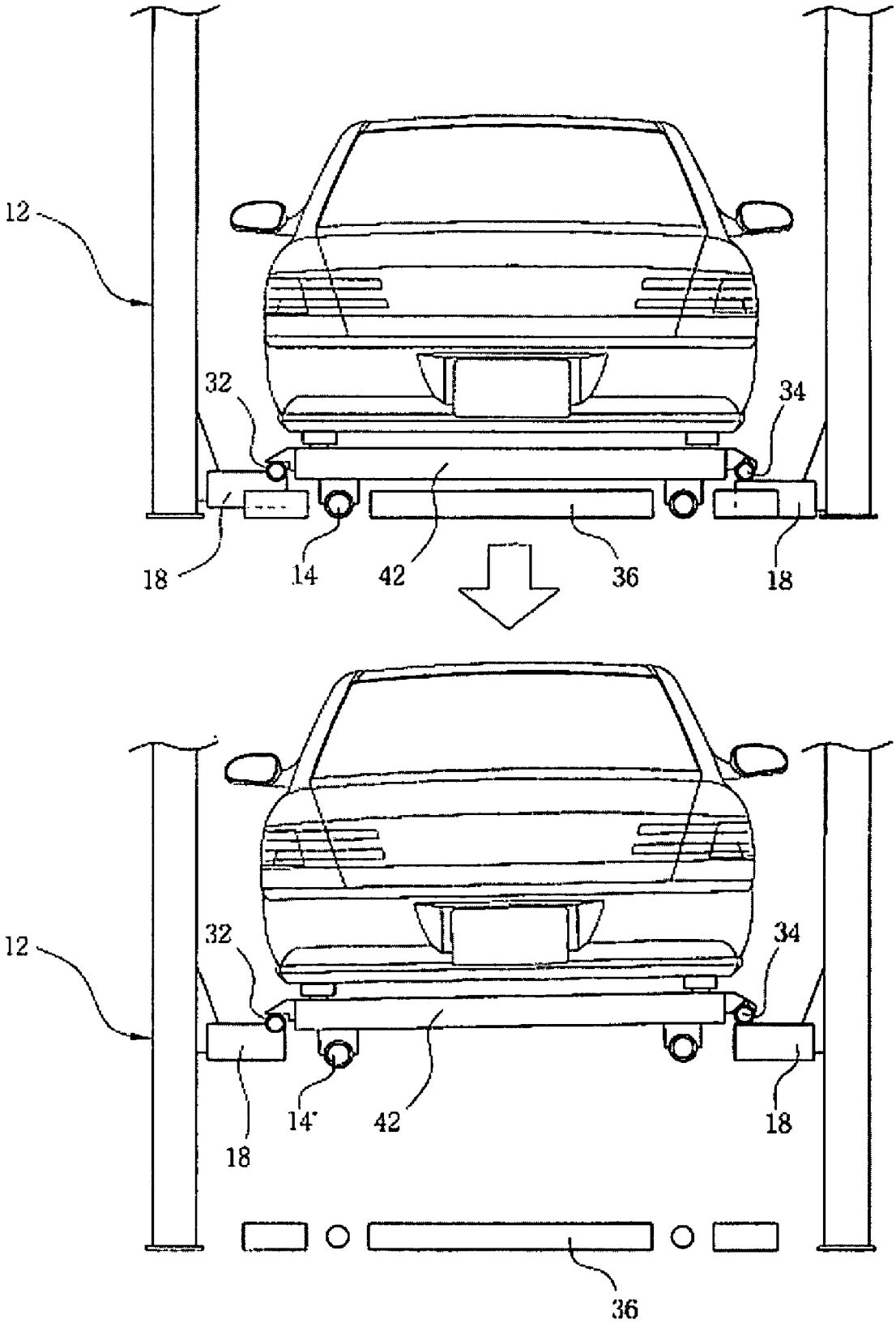
FIG. 5 is a side view of a system for collecting liquids from scrapped vehicles according to one embodiment of the present invention, in which the scrapped vehicle loaded on a lift is tilted when the lift raise the vehicle.

As shown in FIG. 5, the lift 12 according to the present invention raises the scrapped vehicle while slightly tilting the vehicle. The lift 12 may comprise plural carriages 18, which are equipped with engagers 32, 34 of slightly different heights. In the illustrated embodiment, referring especially to FIGS. 1 and 5, the engagers 32, 34 have the same size and shape, but are mounted at different heights on the carriages 18 such that, in effect, one of the carriages 18 is equipped with a cylindrical engager 34 and the other is equipped with a hemicylindrical engager 32. Namely, when the carriages 18 are raised up at the same level of height, a bogie frame and a scrapped vehicle loaded on the carriages 18 are tilted together due to the difference of the height of the engagers 32 and 34 mounted on the carriages 18.

Figure 6:
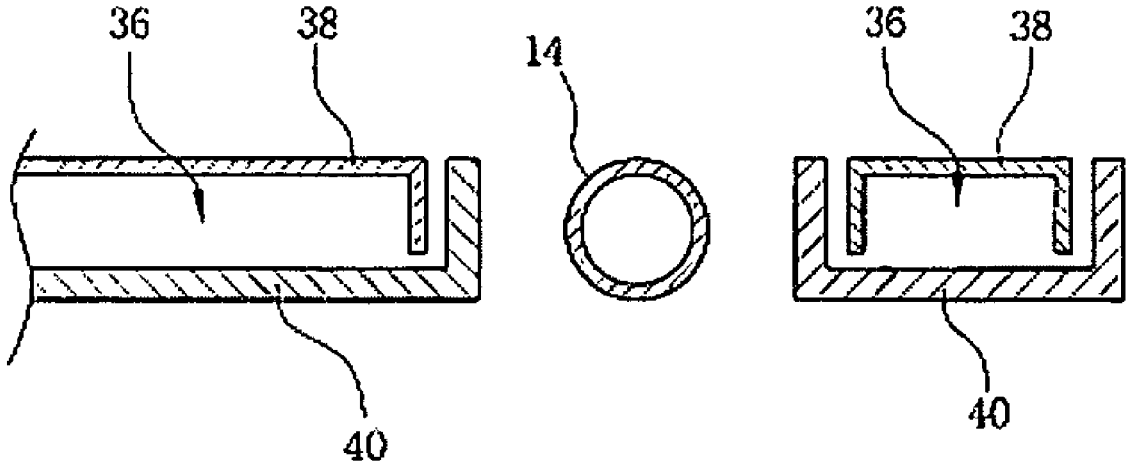
FIG. 6 is a sectional view of a floor of a system for collecting liquids from scrapped vehicles according to one embodiment of the present invention, taken along the line A-A of FIG. 1.

As depicted in FIG. 6, the floor 10 comprises an upper plate 38 whose both sides are perpendicularly bent downward, forming the substantially reversed U-shape and a lower plate 40 whose both sides are perpendicularly bent upwardly forming the substantially U-shape. The upper plate 38 is configured to fit into the lower plate 40 such that a cavity 36 for catchment is formed between the upper plate and the lower plate. The catchment cavity 36 is adapted for collecting liquids falling to the floor 10 during liquids collecting process.

Hereinafter, the operation of a system for collecting liquids from scrapped vehicles according to the preferred embodiment of the present invention is described in detail with reference to the accompanying drawings.

Figure 2:
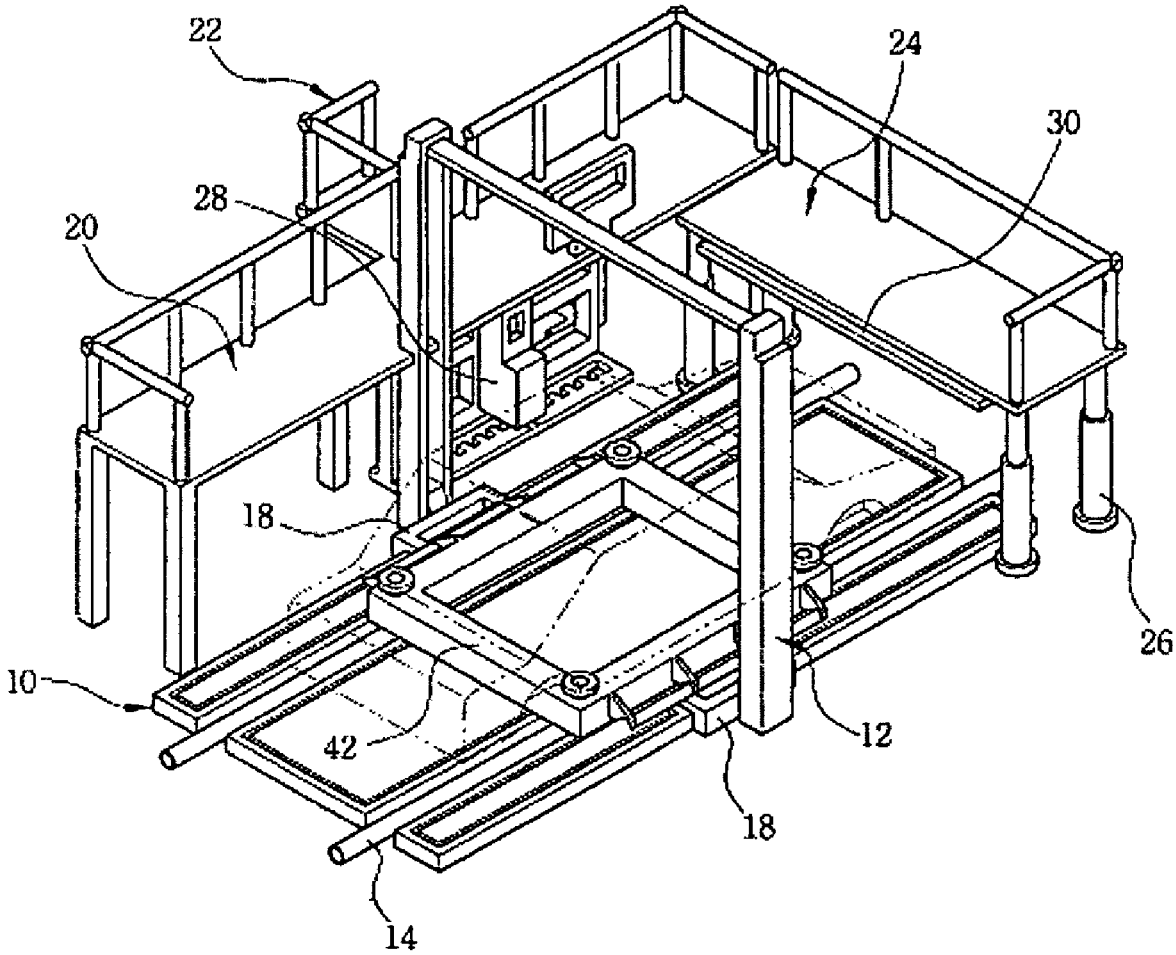
FIG. 2 is a perspective view of a system for collecting liquids from scrapped vehicles according to one embodiment of the present invention, in which a scrapped vehicle is positioned on carriages of a lift.
Figure 3:
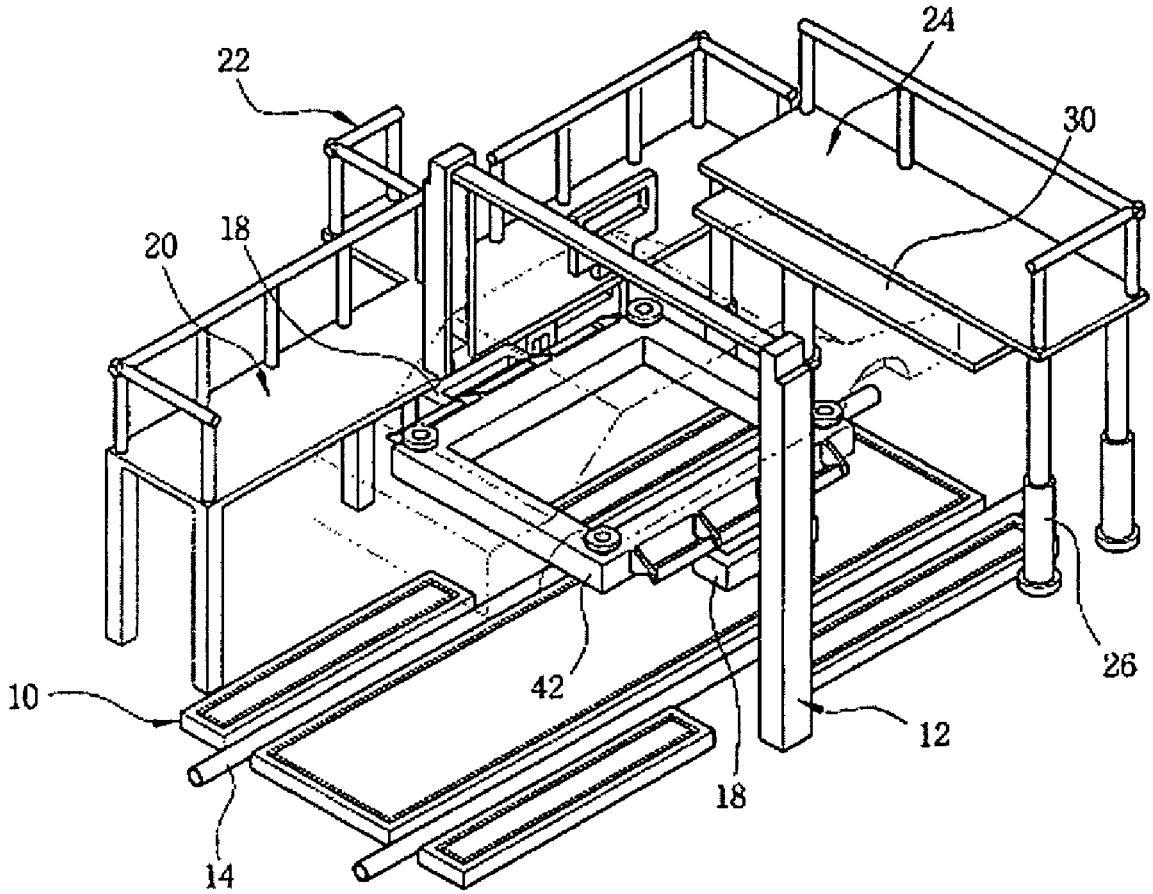
FIG. 3 is a perspective view of a system for collecting liquids from scrapped vehicles according to one embodiment of the present invention, which shows operations of a lift and a second scaffold.
Figure 4:
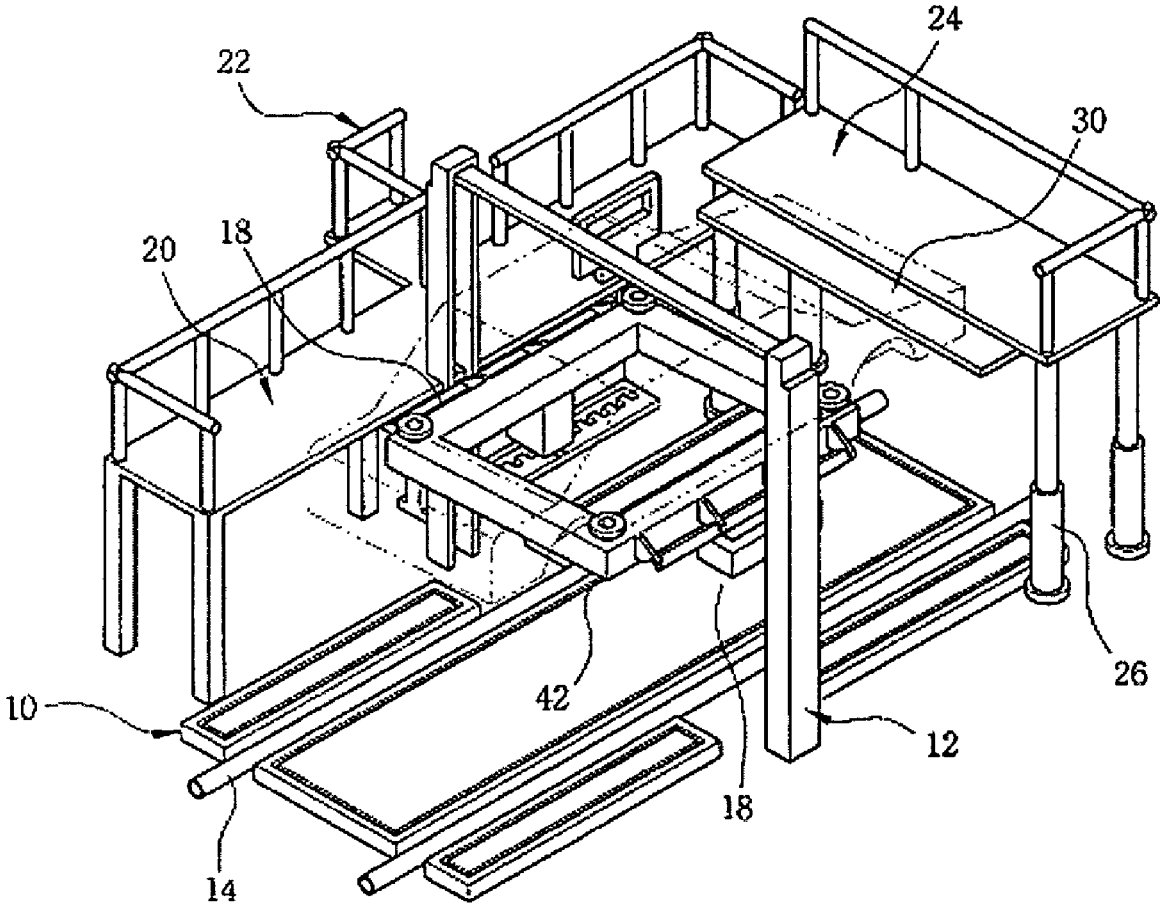
FIG. 4 is a perspective view of a system for collecting liquids from scrapped vehicles according to one embodiment of the present invention, in which the scrapped vehicle loaded on a lift is tilted.

Referring to FIG. 1 and FIG. 2, after preliminary dismantling processes, a scrapped vehicle is loaded on a bogie frame 42 and is transported to the lift 12 of a liquids collecting system along the rail 14. Upon mounting the bogie frame 42 loading the scrapped vehicle on the carriages 18 of the lift 12, an operator manipulates the control panel 28 in order to raise the scrapped vehicle to such an extent that the vehicle is level with the scaffolds 20 and 24. Subsequently, the operator opens a hood of the vehicle and initiates the liquids collecting process, namely, connecting various oil collecting hoses (not shown in FIGS.) to the outlet of the liquids.

Liquids falling to the floor 10 from the vehicle during collecting process are directed to flow into the catchment cavity 36 formed inside of the floor 10 and accumulated therein.

If the height of the second scaffold 24 does not accord with that of the engine compartment of the scrapped vehicle, the operator can adjust the height of the second scaffold 24 by actuating the hydraulic cylinders 26 installed at each corner of the second scaffold 24.

Moreover, when an overall length is relatively shorter than that of an ordinary vehicle, the operator can extend an auxiliary plate 30 to improve the accessibility to the engine compartment of a scrapped vehicle.

The present invention is advantageous in that the scrapped vehicle is positioned on a tilt of about three degree, whereby the liquids remaining in a scrapped vehicle can be minimized.

After completing the liquids collecting process, the bogie frame loading the scrapped vehicle is lowered and withdrawn from the liquids collecting system.

Even though the present invention is described in detail with reference to the foregoing embodiments, it is not intended to limit the scope of the present invention thereto. It is evident from the foregoing that many variations and modifications may be made by a person having an ordinary skill in the present field without departing from the essential concept of the present invention.

What is claimed is:

1. A system for collecting liquids from a scrapped vehicle, comprising:

a floor having rails positioned in a longitudinal direction thereof, on which a bogie frame moves back and forth via the rails;

a lift having plural posts and carriages, the lift raising the bogie frame together with a scrapped vehicle loaded thereon when the bogie frame is mounted on the carriages;

a first scaffold constructed in the longitudinal direction of the floor;

a second scaffold constructed in such a manner that one end of the first scaffold perpendicularly meets one end of the second scaffold;

hydraulic cylinders installed at each corner of the second scaffold, thereby adjusting the height of the second scaffold at need; and a control panel for controlling the operation of collection of liquids from a scrapped vehicle, the control panel being disposed below the first scaffold wherein one of the carriages is equipped with a first engager and the other is equipped with a second engager, the engagers having different heights such that the bogie frame and the vehicle are tilted when they are supported by the engagers;

the system being configured such that a user supported on the first or second scaffold can connect liquid collecting apparatus to the vehicle to thereby collect the liquids from the vehicle.

2. The system for collecting liquids from a scrapped vehicle according to claim 1, wherein the floor is composed of an upper plate of the substantially reversed U-shape and a lower plate of the substantially U-shape, wherein the upper plate is fit into the lower plate such that a cavity for catchment is formed between the upper plate and the lower plate.

* * * * *